US007536793B1

(12) United States Patent
Richmond et al.

(10) Patent No.: US 7,536,793 B1
(45) Date of Patent: May 26, 2009

(54) SAFETY STAND AND KNIFE AND METHOD OF USE

(76) Inventors: David Joseph Richmond, 12400 Wilshire Blvd., Ste. 850, Los Angeles, CA (US) 90025; Juan Fernandez, P.O. Box 312, Towaco, NJ (US) 90025; Paul McGrath, Unknown, Flanders, NJ (US) 90025

( * ) Notice: Subject to any disclaimer, the term of this patent is extended or adjusted under 35 U.S.C. 154(b) by 81 days.

(21) Appl. No.: 11/162,516

(22) Filed: Sep. 13, 2005

(51) Int. Cl.
*A47F 5/16* (2006.01)
*A47F 7/00* (2006.01)

(52) U.S. Cl. ..... 30/298.4; 30/277.4; 211/70.7; 248/37.3

(58) Field of Classification Search ..... 30/277.4, 30/298.4; 211/70.7; 248/37.3; D7/637
See application file for complete search history.

(56) References Cited

U.S. PATENT DOCUMENTS 3,418,713 A * 12/1968 Bauer ..... 30/277.4
4,711,030 A * 12/1987 Ruston, Sr. ..... 30/277.4
5,245,756 A * 9/1993 Howell et al. ..... 30/298.4
6,176,017 B1 * 1/2001 Sato et al. ..... 30/277.4
6,185,826 B1 * 2/2001 Lutz et al. ..... 30/277.4
6,619,487 B2 * 9/2003 Stuchlik, III ..... 211/70.7
6,662,453 B1 * 12/2003 Stuckey et al. ..... 30/298.4
D488,677 S * 4/2004 Reichenbach et al. ..... D7/637

* cited by examiner

*Primary Examiner*—Hwei-Siu C Payer
(74) *Attorney, Agent, or Firm*—Swanson & Associates; Elizabeth Swanson

(57) ABSTRACT

The invention provides a safety stand for storing one or more knives or knife blades. The stand may have a lock that automatically retains inserted blades or knives and prevents their inadvertent removal. The invention also provides for methods of using the stand for inserting and removing knife blades without a user having to touch the blade itself, thereby reducing the risk of being cut.

9 Claims, 8 Drawing Sheets

SAFETY STAND AND KNIFE AND METHOD OF USE

BACKGROUND

Like kitchen knifes used for slicing bread or for carving meat and fish, rechargeable battery operated kitchen knives have become necessary in most homes. Such knives typically comprise a knife handle containing a motor and batteries and employ a pair of slideably disposed, serrated knife blades to cut food by reciprocating action. The set of blades is removably fixed into the knife handle and powered by the motor. The blades are typically sharp, move rapidly when in use, and are inserted into and removed from the knife handle by hand.

Users are often careful not to cut themselves while using such knives to cut food, recognizing the danger of the moving blades. However, a user may lower this level of care when inserting the blades into the knife's handle or removing them, and so may cut themselves inadvertently on the exposed knife's serrated edges. The chances of being cut increase each time a set of blades is handled, and each set is typically handled twice per use, namely once to insert and once to remove the blades.

To insert a set of blades, a user generally holds the knife handle in one hand while grasping and inserting the set of blades into the handle with the other hand. Often, pressure must be applied to firmly seat the blades within the handle, and the pressure is borne by the blades bearing hand of the user.

To remove the blades, a knife's handle may have a release mechanism activated by the user, which releases the blades so that they may fall out of the handle onto a surface below. The user then picks them up for cleaning or storage. Alternatively, blades are removed when the user activates the release mechanism with one hand while grasping and pulling the blades with the other hand. Some knives do not have a release mechanism and rely on the user being able to firmly grasp and remove the blades by grasping and pulling alone.

A user may own several blade sets, each set configured to cut a different food. Since each knife handle typically holds only one set of blades at a time, the idle sets of blades need to be stored safely. When the sets are pairs of reciprocating blades, the slideably interconnected blades sit side by side, and each set of blades is thicker than a conventional knife's single blade. Consequently, a set of electric knife blades typically can't be stored in conventional knife blocks for single bladed knives.

Without safe storage, removable blades are often kept loose in a utensil drawer or some container. A user must then grasp the blades to remove them, often while pushing aside other utensils or objects, providing another opportunity for being cut by the serrated blades. As each blade is sharp and the pair of them often slip or slide relative to one another while they are being handled, it is not surprising when a user is cut while handling a set of blades.

Users are typically careful to keep a knife away from a child or infant while it is assembled and being used. But children are known for reaching up onto kitchen counters or into drawers and grabbing at harmful objects, such as a pair of loose knife blades or even an assembled rechargeable knife. It is easy to imaging how a child could be injured by the exposed blades.

A child or young person using an electric knife may not know the correct pressure to apply to the edge of the blades while grasping them for removal or insertion, or the knife handle may slip out of the child's grasp. In an attempt to recover, the child may be cut in an attempt to grab the falling knife or blades.

Standard or traditional knives, comprising a knife blade fixed to a knife handle, often are stored, blade down, in slots defined within a "knife block," and the knives are held therein by gravity. Even so, a knife block storage system does not provide the safest means for storing such knives, as the knives will typically fall out of the slots, exposing the knife blades, if the block is tipped or falls.

It is the object of the instant invention to provide a safer knife storage device. It is another object of the invention to provide a safer knife blade changing device. It is another object of the invention to provide methods for safely inserting, removing and changing knife blades.

DRAWINGS

The invention will now be described by way of drawing figures where:

Figure 1:
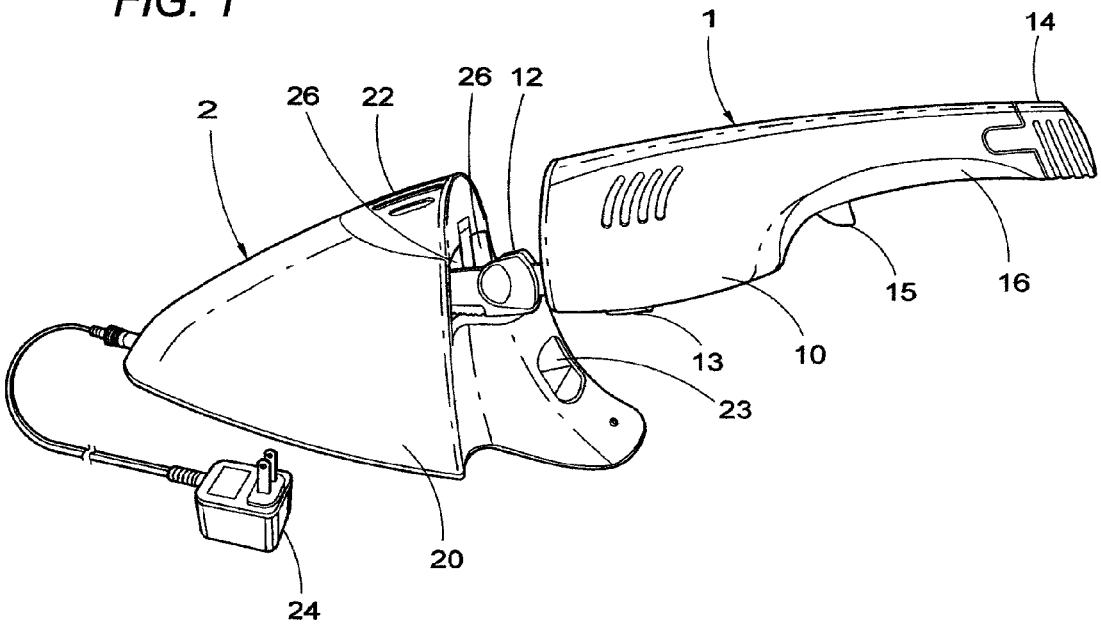
FIG. 1 is a perspective view of one embodiment of a knife and safety stand of the present invention, the knife partly inserted in the safety stand.
Figure 6A:
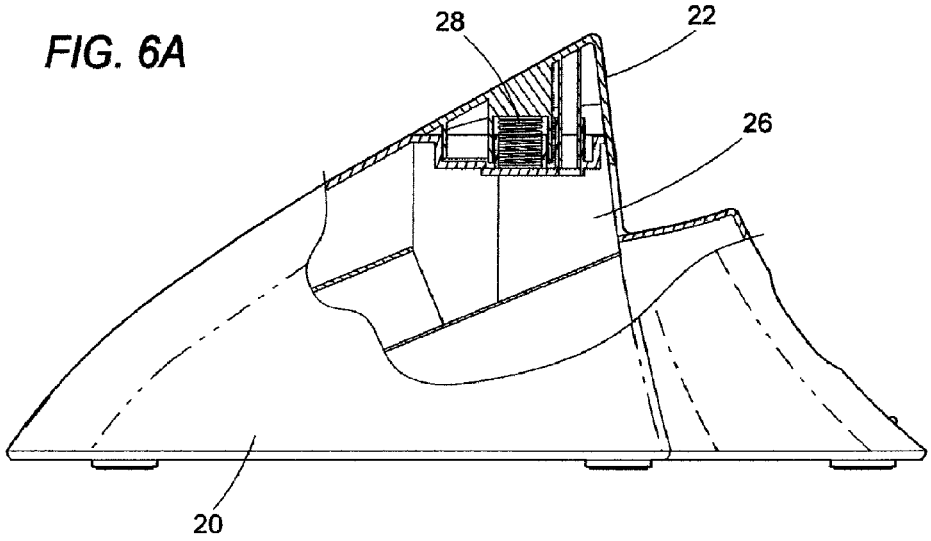
Figure 6B:
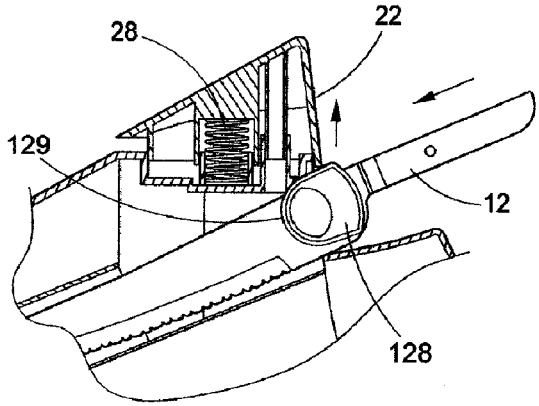
Figure 6C:
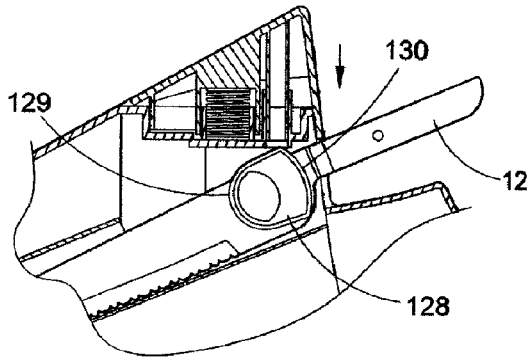

FIGS. 6A, 6B and 6C side elevation of the stand of FIG. 1 with part of the outer housing cover removed and in partial section showing two positions of the blade lock relative to the stand base while a knife blade is being inserted into the stand.

Figure 7:
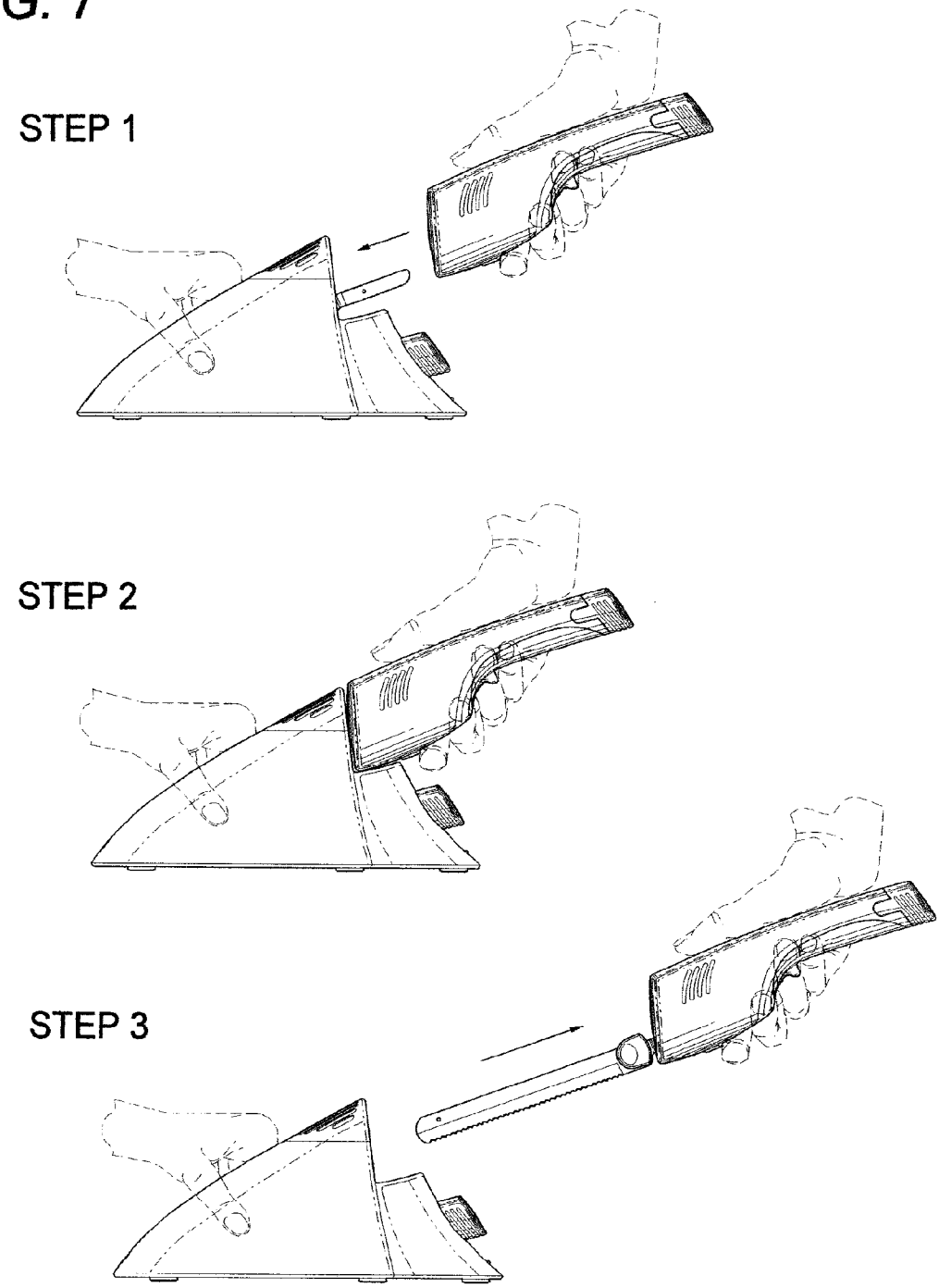
Figure 8:
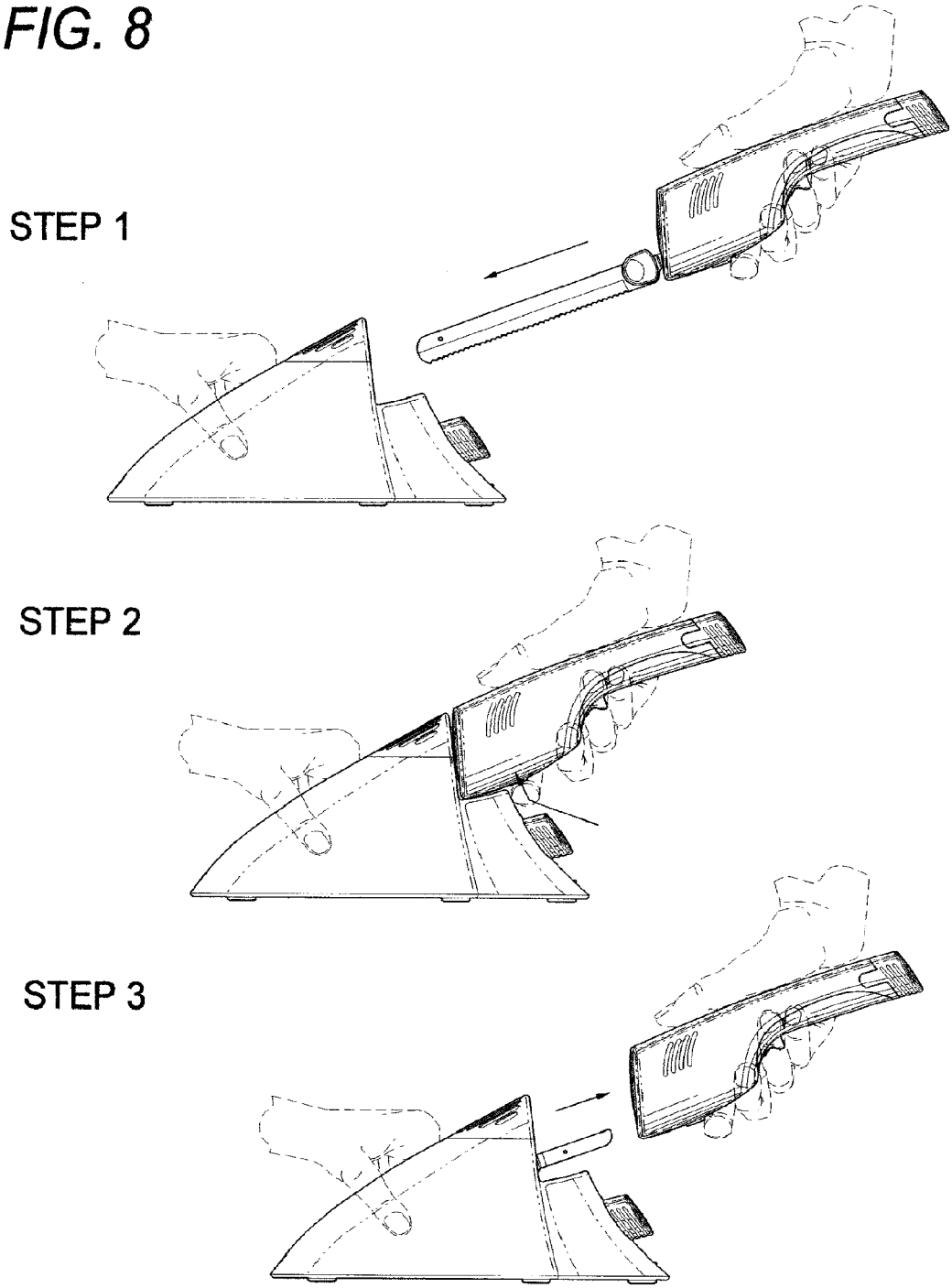

FIG. 7 illustrates steps for safely inserting one or more knife blades into a knife handle, according to one method of the invention; and FIG. 8 illustrates steps for removing one or more knife blades from a knife handle according to another method of the invention.

SUMMARY OF THE INVENTION

The objects of the invention have been accomplished by providing: a knife and safety stand device that obviates the need for handling knife blades when inserting them into or removing them from a knife handle; a stand configured to firmly hold and store a knife, without permitting knife removal therefrom using only one hand; a stand configured to firmly hold and store idle knife blades; a method for safely inserting one or more knife blades into a knife handle; and a method for safely changing one or more knife blades in a knife with removable blades.

DETAILED DESCRIPTION

With reference first to FIG. 1, the device of the invention is shown generally to include a knife 1 and a safety stand 2. The knife 1 has a handle 10 and at least one blade 12. The safety stand 2 defines at least one blade slot configured to accept the at least one blade 12. The safety stand 2 further includes a blade lock 22 configured to retain at least one blade 12 in the blade slot wherein it rests.

If the knife of FIG. 1 is a rechargeable electric knife, it generally includes: a handle 10; a motor within the handle 10; at least one removable knife blade 12; a blade release 13; a power source for the motor, for example a removable, rechargeable battery pack 14; a trigger 15 to control the motor; and a grip 16.

In FIG. 1, the safety stand is shown generally at reference numeral 2 to include a safety stand base 20 and a blade lock 22. For an electric knife, the safety stand generally includes: a battery pack recharging port 23 and a power cord 24 that supplies power to the battery pack recharging port 23.

Figure 2:
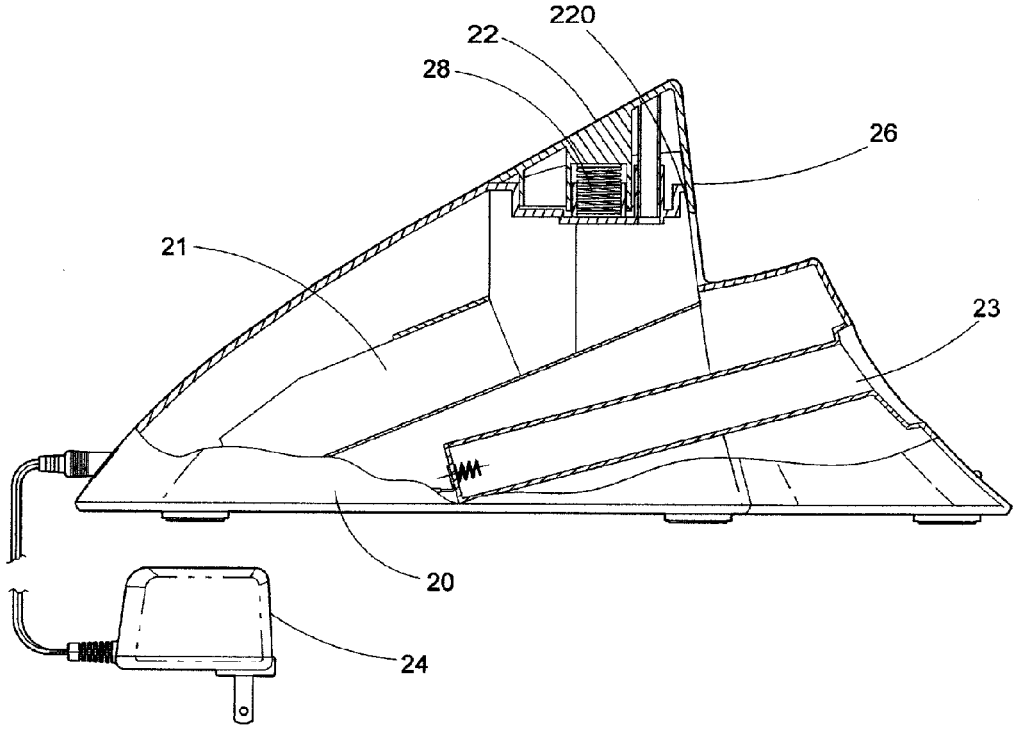
FIG. 2 is a side elevation of the stand of FIG. 1 with approximately one-half of the outer housing cover removed, and partially in section.

Referring now with particularity to FIG. 2, while the stand base 20 itself defines at least one blade slot 21 configured to accept at least one knife blade 12, stand base 20 and blade lock 22 together define at least one blade opening 26. The blade lock 22 is connected to stand base 20 by a connector 28 that may be elastic, may be resilient, or that may embody both elasticity and resilience. The blade lock has an inner wall 220. Whenever at least one knife blade 12 is to be inserted into the blade slot 21 in the stand base 20, the blade 12 first must pass through blade opening 26.

Figure 3:
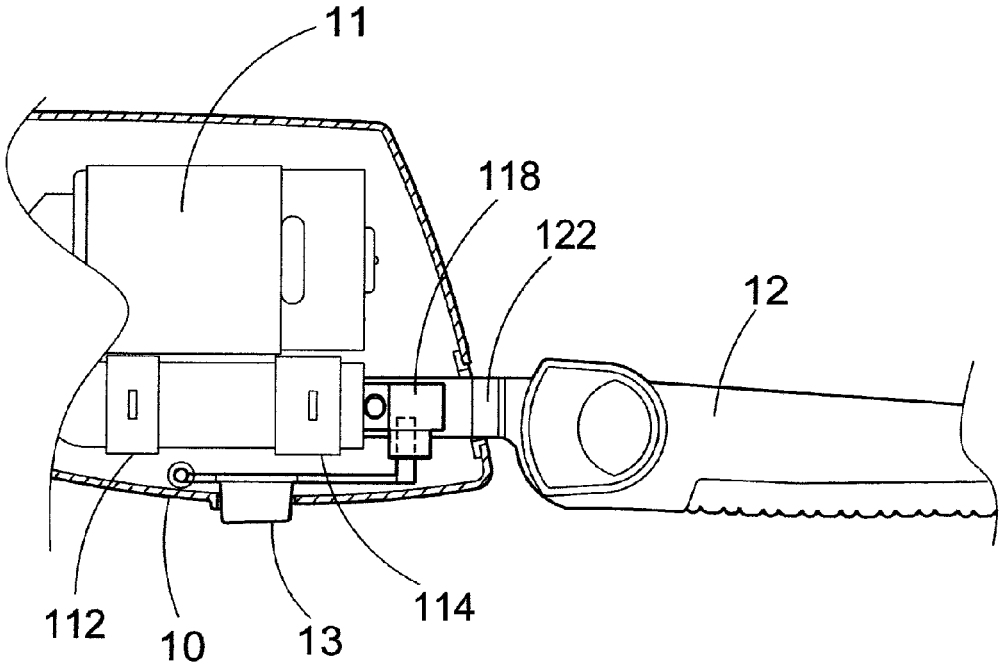
FIG. 3 is a side elevation of a portion the knife of FIG. 1 with part of the outer housing cover removed.

With respect to FIG. 3, the knife handle 10 generally has a pair of blade drivers 110 which slideably reciprocate within guide members 112, 114 when the drivers 110 are powered by the motor 11. Generally, removable electric knife blades 12 have insertion ends 122 configured to mate with the blade drivers 110.

Figure 4A:
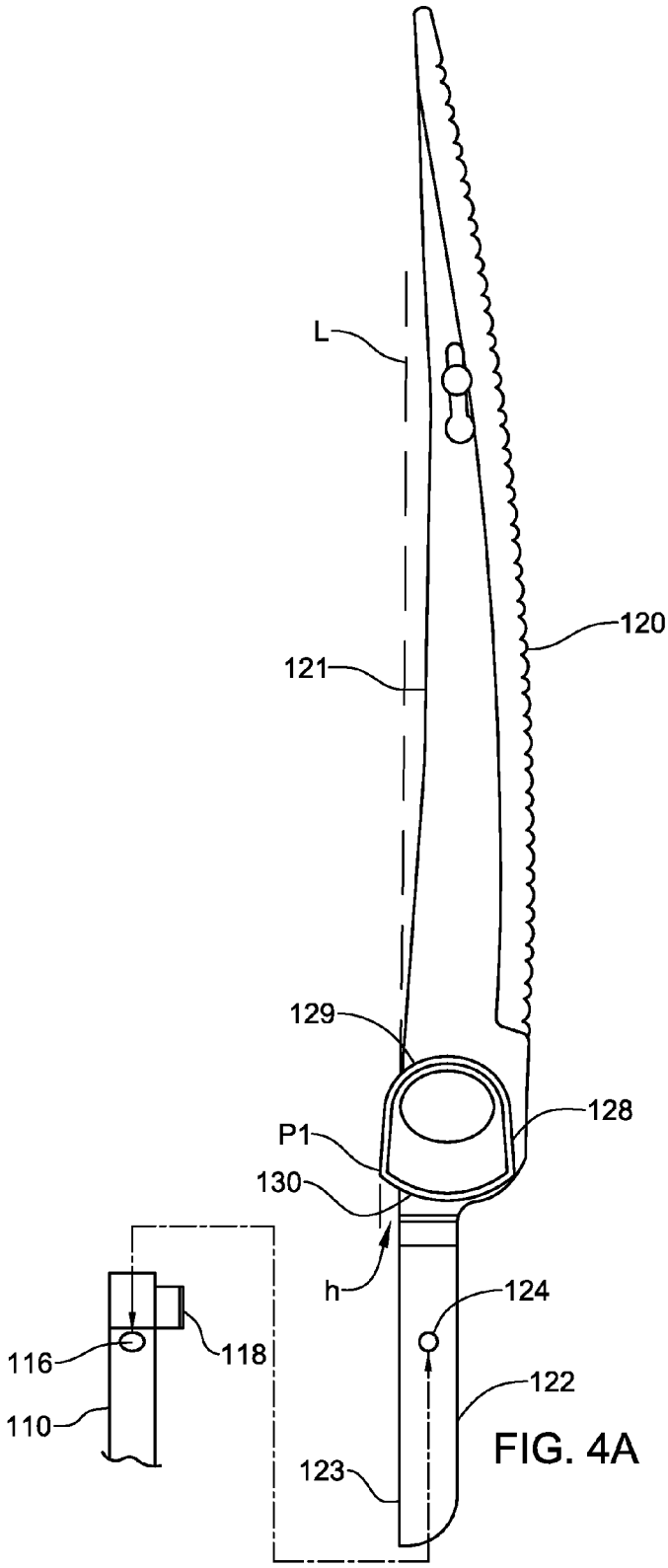
FIG. 4A is a side view of a blade driver and FIG. 4B, and a top view of a pair of blades, according to one embodiment of the present invention.
Figure 4B:
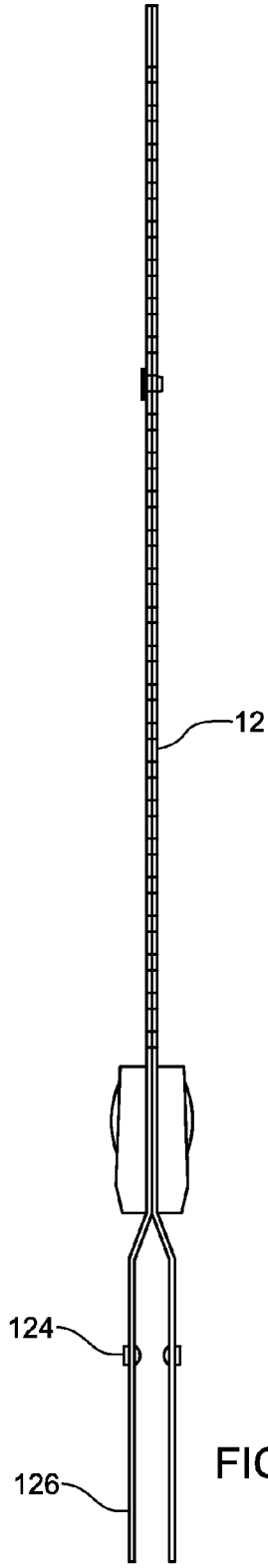
Figure 5A:
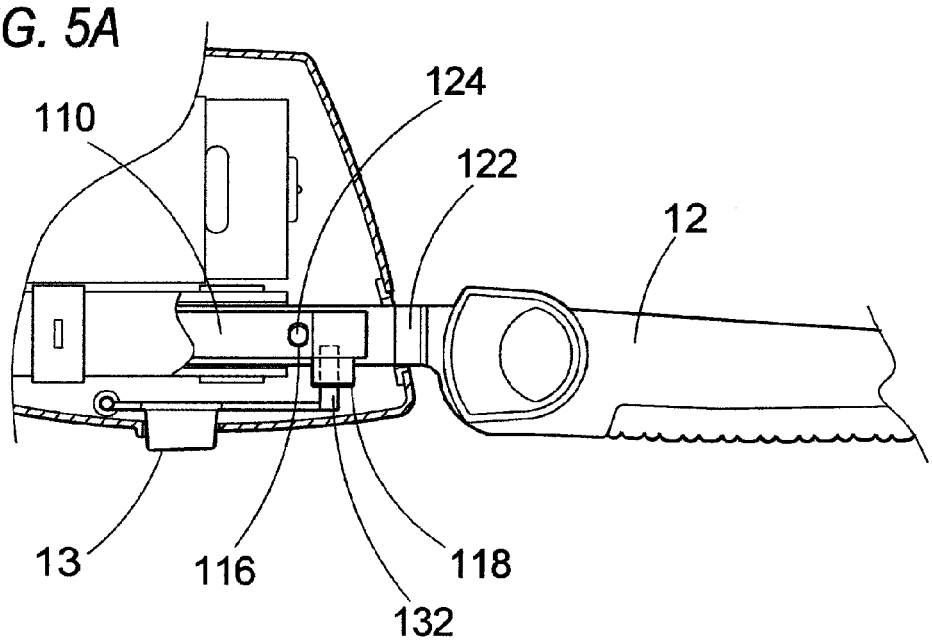
FIGS. 5A and 5B are side views of a portion of the knife of FIG. 1 with part of the outer housing cover removed, illustrating two positions of the blade release.
Figure 5B:
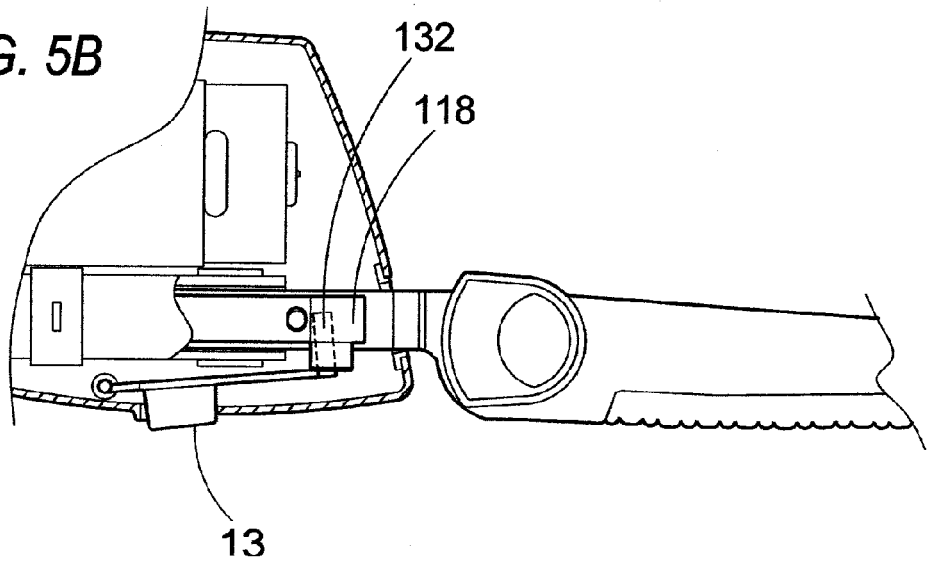

In FIG. 4 and FIG. 5, illustrating one embodiment of the invention: Each insertion end 122 has an outward projection 124 that extends from the plane of one surface 126 of each blade 12. The blade drivers 110 move within guides 112, 114 and are configured to accept the outward projections 124 within depressions 116. When so mated and retained within the guides 112, 114, the blades 12 and drivers 110 are securely fastened together.

Each blade driver 110 of this embodiment also has a flange 118, and the blade release 13 defines upward extensions 132 that are configured to engage the flanges 118. When the blade release 13 is pressed, the extensions 132 engage the flanges 118, forcing the projections 124 and depressions 116 apart, enabling removal of the blades 12 from the knife's handle 10.

Further, as to each blade 12 shown in the embodiment illustrated in FIG. 4A, each blade 12 comprises a lower cutting edge 120, an upper non-cutting edge 121, a blade insertion end 122, an upper edge 123 of the insertion end 122, and a lock sentry 128. The lock sentry 128 of each blade 12 has a curved leading surface 129 and a curved rear surface 130. As shown in FIG. 4A, point P1 is located at where these two curved surfaces 129, 130 intersect. The upper edge 123 of the blade insertion end 122 defines a line L. The shortest distance measured from L to P1 is equivalent to the height h of the rear surface 130 of the lock sentry 128. Generally, h may vary from about 1 mm to about 20 mm. In the embodiment illustrated in FIG. 4A, h is between 4 mm and 8 mm.

With reference now to FIG. 6: In FIG. 6A, the embodiment illustrated has a blade lock 22 attached to safety stand 2 by elastic connector 28, and blade lock 22 is held snugly against the stand base 20 thereby.

Still referring to FIG. 6: As in FIG. 6B, when at least one blade 12 is inserted into blade opening 26, the blade lock 22 is forced upwards and away from the stand base 20 by leading edge 129 of each lock sentry 128. The elastic connector 28 is configured to permit this forced displacement of the lock 22 when at least one blade 12 is inserted into a blade opening 26. As shown in FIG. 6C, by force of the elastic connector 28, lock 22 resumes its original position once the rear edge 130 of the lock sentry 128 has cleared the inner surface 220 of the blade lock 22.

The rear edge of the lock sentry 128 is configured to abut an inner wall of the blade lock 22. The rear edge 130 is further configured not to displace the lock 22 upwards and away from the stand base 20 when a blade removing force is exerted on at least one blade 12 without simultaneously stabilizing the safety stand 2. When the blade 12 and stand 2 are so positioned, a portion of rear edge 130 at least as great as height h abuts the inner wall 220 of blade lock 22. When a blade removing force is exerted on at least one blade 12 alone, this force causes retention of the blade 12 by the combined effects of the elastic container 28, the height h of the lock sentry 128 above the top edge of the blade 12, and the configuration of the rear edge 130 of the lock sentry 128 and its abutment against the inner wall 220 of the blade lock 22.

With reference to FIG. 4 and FIG. 6, the elastic connector 28 and the height h of the lock sentry 128 above the top edge of the blade 12 are configured to force up the blade lock 22 and permit blade 12 to be withdrawn from the blade slot 21 when a removing force is exerted on blade 12 simultaneously with a stabilizing force being exerted on safety stand 2.

In a second embodiment of the invention, not shown in the drawings, the connector 28 is resilient. The term "connector" does not require that a resilient connector 28 be permanently connected to either the safety stand 2 or the blade lock 22. Together, blade lock 22 and safety stand 2 define at least one blade opening 26 configured to permit at least one blade 12 to pass there through without displacement of the blade lock 22.

When the lock 22 is pressed down flush with the stand base 20, the rear edge 130 of the lock sentry 128 is configured to abut an inner wall 220 of the blade lock 22, and to prevent removal of blades 12 from the blade opening 26 as long as downward pressure on the lock 22 is maintained. When so positioned and a blade removing force is exerted on the blades 12, the lock 22 retains the blades 12 as long as the lock 22 remains pressed and in the abutment position described above. The height h, the applied downward force, and the configuration of the rear edge of the lock sentry 128 combine to retain the knife blade 12 in the blade opening 26.

Referring still to this second embodiment, not shown in the drawings, when a user inserts at least one blade 12 into the opening 26 with one hand, and with the other hand, presses down on the lock 22, the user is unable to remove the assembled knife 1 from the stand 2 as long as the lock 22 is pressed into the abutment position. However, the blade release 13 is accessible, and a user may release the knife's blade 12 into the blade slot 21 by pressing the blade release 13 on the handle 10. The user can then remove the handle 10 free of the blades 12.

Still referring to this second embodiment, a user may insert a pair of blades 12 already positioned in the safety stand 2 into an empty handle 10. This insertion is effected by the user stabilizing the stand 2 with one hand, using the other hand to position the knife handle 10 to permit the insertion ends 122 of the positioned blades 12 to mate with the blade drivers 110 in the handle 10. The assembled knife 1 may then be withdrawn from the stand 2 or may be stored therein.

With reference now to FIG. 7, to remove blades 12 retained in the safety stand 2 of the first embodiment, one of two methods may be used. The blade lock 22 may be pulled upwards with one hand while the blades 12 are removed using the other hand. Alternately, a user firmly stabilizes the stand 2 with one hand while exerting a removing force on the blades 12 with the other hand.

The stands in either embodiment are further configured to balance and hold an assembled knife 1 by its blades 12 within the safety stand 2, to hold blades 12 alone within the stand 2, or to hold a combination of blades 12 and an assembled knife 1. There is no apparent limit to the number of blade openings 26 that a stand 2 may have.

While the present invention has been described with reference to embodiments thereof, it is to be understood that the invention is not limited to these embodiments or constructions. To the contrary, the invention is intended to cover various modifications or constructions. In addition, while the various elements of the provided embodiments are shown in various combinations and configurations, which are exemplary, other combinations and configurations, including more, less or only a single element, are also within the spirit and scope of the invention.

What is claimed is:

1. A device comprising:

an electric powered knife having a handle and a pair of blades, the handle having a motor configured to power a pair of motorized blade drivers;

the knife handle further configured to removably attach the pair of blades to the blade drivers and having a blade release configured to enable release of the blades therefrom;

each blade of the pair of blades further having a lower cutting edge, an upper non-cutting edge and a handle insertion end;

each blade of the pair of blades having a lock sentry positioned about the blade proximate the handle insertion end, the lock sentry having a curved leading surface, a curved rear surface, and a point (P1) located at where these two curved surfaces intersect;

the insertion end of each blade further having an upper edge extending longitudinally from the non-cutting edge, each upper edge further defining a line (L);

each lock sentry further having a height (h) measured as the shortest distance between the point (P1) and the line (L);

the knife having the handle insertion ends of the pair of blades inserted in the handle and removably mated with the blade drives; and a stand base having a blade lock connected thereto and defining at least one blade slot and configured to receive the pair of blades, the blade lock further configured to accept and retain the pair of blades within the at least one blade slot, the blade lock further configured to be urged open by insertion of the curved leading surfaces of the lock sentries positioned about the pair of blades.

2. The device of claim 1 wherein the height (h) is from about 1 mm to about 20 mm, and the blade lock is configured to mechanically retain the blades by retaining the lock sentries.

3. The device of claim 1 wherein the stand base and the blade lock are elastically connected.

4. The device of claim 1 wherein the stand base and the blade lock are resiliently connected.

5. A device comprising:

an electric powered knife having a handle and a pair of blades, the handle having a motor configured to power a pair of motorized blade drivers;

the knife handle further configured to removably attach the pair of blades to the blade drivers and having a blade release configured to enable release of the blades therefrom;

each blade of the pair of blades having a lower cutting edge, an upper non-cutting edge, a lock sentry and a handle insertion end, an upper edge of the handle insertion end that defines a line (L), and wherein the upper edge extends longitudinally from the non-cutting edge;

the lock sentry having a curved leading surface and a curved rear surface, each lock sentry having a point (P1) located at where these two curved surfaces intersect;

the knife having the handle insertion ends of the pair of blades inserted in the handle and removably mated with the blade drivers; and a stand base having a blade lock connected thereto and defining at least one blade slot configured to receive and retain each lock sentry having a height (h) measured at the shortest distance between the point (P1) and the line (L), the stand base and the blade lock inter-connected by an elastic connect, the blade lock configured to be urged open by the introduction of the lock sentry, and to retain the pair of blades within the at least one blade slot.

6. The device of claim 5 wherein the handle insertion end of each blade has a surface and an outward projection projecting from that surface, which projection is configured to removably mate with the respective blade driver and further the blade release is configured to substantially engage with a flange of the respective blade driver and enable release of the blades therefrom.

7. The device of claim 5 wherein the height (h) is from about 1 mm to about 20 mm.

8. The device of claim 5 wherein the curved rear surface is configured to abut an inner wall of the blade lock, the height (h) is from about 1 mm to about 20 mm, and which sentry is further configured not to displace the blade lock upwards and away from the stand base when a blade removing force is exerted on at lest one of the blades without simultaneous stabilization of the stand base.

9. A device comprising:

an electric powered knife having a handle and a pair of blades, the handle having a motor configured to power a pair of motorized blade drivers;

the knife handle further configured to removably attach the pair of knife blades to the blade drivers and having a blade release configured to enable release of the blades therefrom;

each blade of the pair of blades having a handle insertion end;

each blade handle insertion end having a lock sentry;

the knife having the handle insertion ends of the pair of blades inserted in the handle and removably mated with the blade drivers; and a safety stand defining at least one blade slot configured to receive the pair of blades, the stand having a stand base and a blade lock connected thereto by a connector, the blade lock configured to accept and retain the pair of blades within the at least one blade slot; and further wherein the connector is resilient, the lock sentry has a rear edge configured to abut an inner wall of the blade lock and to prevent removal of blades from the stand as long as downward pressure by the resilient connector on the blade lock is maintained.

* * * * *